US007494123B2

(12) United States Patent
Defosse et al.

(10) Patent No.: US 7,494,123 B2
(45) Date of Patent: Feb. 24, 2009

(54) MECHANICAL DEVICE FOR MEASURING THE WIDTH OF A MAIL ITEM

(75) Inventors: Sébastien Defosse, Le Plessis Robinson (FR); Thierry Le Jaoudour, Verrieres le Buisson (FR)

(73) Assignee: NEOPOST Technologies, Bagneux (FR)

( * ) Notice: Subject to any disclaimer, the term of this patent is extended or adjusted under 35 U.S.C. 154(b) by 376 days.

(21) Appl. No.: 11/341,586

(22) Filed: Jan. 30, 2006

(65) Prior Publication Data

US 2006/0214349 A1 Sep. 28, 2006

(30) Foreign Application Priority Data

Jan. 31, 2005 (FR) ..... 05 00930

(51) Int. Cl.
*B65H 9/04* (2006.01)

(52) U.S. Cl. ..... 271/255; 271/230

(58) Field of Classification Search ..... 271/230, 271/255

See application file for complete search history.

(56) References Cited

U.S. PATENT DOCUMENTS

| | | | | |
|---|---|---|---|---|
| 4,978,114 | A * | 12/1990 | Holbrook | 271/35 |
| 6,006,210 | A * | 12/1999 | Freeman et al. | 705/402 |
| 6,289,730 | B1 * | 9/2001 | Elgee | 73/159 |
| 6,380,503 | B1 * | 4/2002 | Mills et al. | 209/586 |
| 6,389,327 | B1 * | 5/2002 | Thiel | 700/227 |
| 6,611,787 | B2 * | 8/2003 | Stringer et al. | 702/159 |
| 6,765,191 | B2 * | 7/2004 | Hollis et al. | 250/221 |
| 6,832,213 | B2 * | 12/2004 | Freeman et al. | 705/410 |
| 7,297,930 | B2 * | 11/2007 | Defosse | 250/222.1 |
| 2003/0062669 | A1 * | 4/2003 | Yamakawa et al. | 271/176 |
| 2004/0061283 | A1 * | 4/2004 | Hyun | 271/265.01 |

FOREIGN PATENT DOCUMENTS

WO WO 03/102501 A1 12/2003

* cited by examiner

*Primary Examiner*—Patrick H Mackey
*Assistant Examiner*—Howard Sanders
(74) *Attorney, Agent, or Firm*—Sughrue Mion, PLLC

(57) ABSTRACT

A mechanical device for measuring the width L of a mail item on the fly in a mail handling machine in which mail items are caused to move along a mail item conveyor path, parallel to a reference wall; said mechanical device comprising a device for detecting a leading edge of a mail item, a downstream lever disposed across the mail item conveyor path and forming a determined angle relative to said reference wall, a device for detecting said downstream lever moving as the leading edge of the mail item goes past, a device for determining a movement distance over which the leading edge of the mail item moves between the device for detecting a leading edge of a mail item and a point of activation at which said leading edge activates said downstream lever, which point of activation is determined by the device for detecting the downstream lever moving, and a computation device for computing the width L of the mail item on the basis of said movement distance.

11 Claims, 3 Drawing Sheets

MECHANICAL DEVICE FOR MEASURING THE WIDTH OF A MAIL ITEM

TECHNICAL FIELD

The present invention relates to the field of mail handling. It relates more particularly to a mechanical device for measuring the width of a mail item conveyed through a franking or postage meter system.

PRIOR ART

A mail handling machine that is provided with a dimensional rating capability for postage pricing purposes is already known, e.g. from Document U.S. Pat. No. 6,006,210 (Pitney Bowes). In that machine, the width of the mail item is actually measured by means of strips of diodes. That apparently simple solution is however extremely costly in practice because it assumes that a plurality of strips are used or that a single, very long strip is used.

A system for determining the dimensions of the mail item being conveyed in order to assign a precise amount of postage to it is also known from Patent Document U.S. Pat. No. 6,169,978 (Siemens) but that system is sophisticated.

OBJECTS AND DEFINITION OF THE INVENTION

An object of the present invention is thus to remedy the above-mentioned drawbacks and to make it possible to measure the width L of a mail item for franking purposes, without it being necessary to use costly technical devices that employ optical systems for taking such a measurement. An object of the invention is also to perform such measurement on the fly, i.e. while the mail item is being conveyed through the franking system and without said franking system being stopped.

These objects are achieved in accordance with the invention by means of a mechanical device for measuring the width L of a mail item on the fly in a mail handling machine in which mail items are caused to move along a mail item conveyor path, parallel to a reference wall;

said mechanical device comprising a device for detecting a leading edge of a mail item, a downstream lever disposed across said mail item conveyor path and forming a determined angle relative to said reference wall, a device for detecting said downstream lever moving as said leading edge of the mail item goes past, a device for determining a movement distance over which said leading edge of the mail item moves between said device for detecting a leading edge of a mail item and a point of activation at which said leading edge activates said downstream lever, which point of activation is determined by said device for detecting said downstream lever moving, and a computation device for computing said width L of the mail item on the basis of said movement distance.

Thus, it is possible, with this simple and entirely mechanical structure, to measure the width of a mail item with high precision and without interrupting the conveying of said item.

In an alternative embodiment, the device further comprises an upstream lever disposed across said mail item conveyor path and forming a determined angle relative to said reference wall, a device for detecting said upstream lever moving as said leading edge of the mail item goes past, said device for determining a movement distance over which said leading edge of the mail item moves also determining a movement distance over which said leading edge of the mail item moves between said device for detecting a leading edge of a mail item and a point of activation at which said leading edge activates said upstream lever, which point of activation is determined by said device for detecting said upstream lever moving.

This advantageous provision makes it possible to measure mail item width even if the mail item is not jogged against the reference wall, provided that the mail item moves parallel to the reference wall.

Advantageously, said device for determining a movement distance over which said leading edge of the mail item moves comprises a counter which is caused to start counting by said device for detecting a leading edge of a mail item and which is caused to stop counting by said detection device(s) for detecting said lever(s) moving.

Preferably, each lever is hinged to a shaft secured at both of its ends to a frame of the mail handling machine.

Advantageously, each hinged lever is preferably swan-necked in general shape, with an advantageously triangular first end portion designed to pass through an opening in a deck of the mail handling machine, and a second end portion that is opposite to the first end portion about the pivot axis of said common shaft, and that is designed to receive a first end of at least one resilient element whose other end is secured to a support bar mounted parallel to said common shaft in the frame.

Preferably, said second end portion further has a moving first element designed to co-operate with a stationary second element secured to the frame of the mail-handling machine so as to form said device for detecting the lever moving.

The present invention also provides any mail handling machine including a mechanical device as defined above for measuring the width L of a mail item on the fly.

BRIEF DESCRIPTION OF THE DRAWINGS

Other characteristics and advantages of the present invention appear from the following description of particular embodiments given by way of example and with reference to the accompanying drawings, in which.

DETAILED DESCRIPTION OF PREFERRED EMBODIMENTS

Mail items are rated for postage pricing purposes on the basis of mail item weight and of mail item size (thickness, envelope length, and envelope width). It is a question either of verifying that the dimensions of the envelope are greater than thresholds, or of verifying that the envelope length to envelope width ratio lies within two limits (e.g. $1.3<R<2.5$ for the USA, and R<square root of 2 for Germany).

In order to assign the appropriate postage price to each mail item in a non-uniform batch, a measurement device that measures the weight and the dimensions of each envelope and that transmits the resulting information to a postage price computer is disposed upstream from the franking module of a mail handling machine, in general at the feed module or "feeder" thereof. The mail item can also be weighed separately by means of an independent weigh module disposed on the path along which the envelopes are conveyed, e.g. between the feeder and the franking module.

Figure 1:
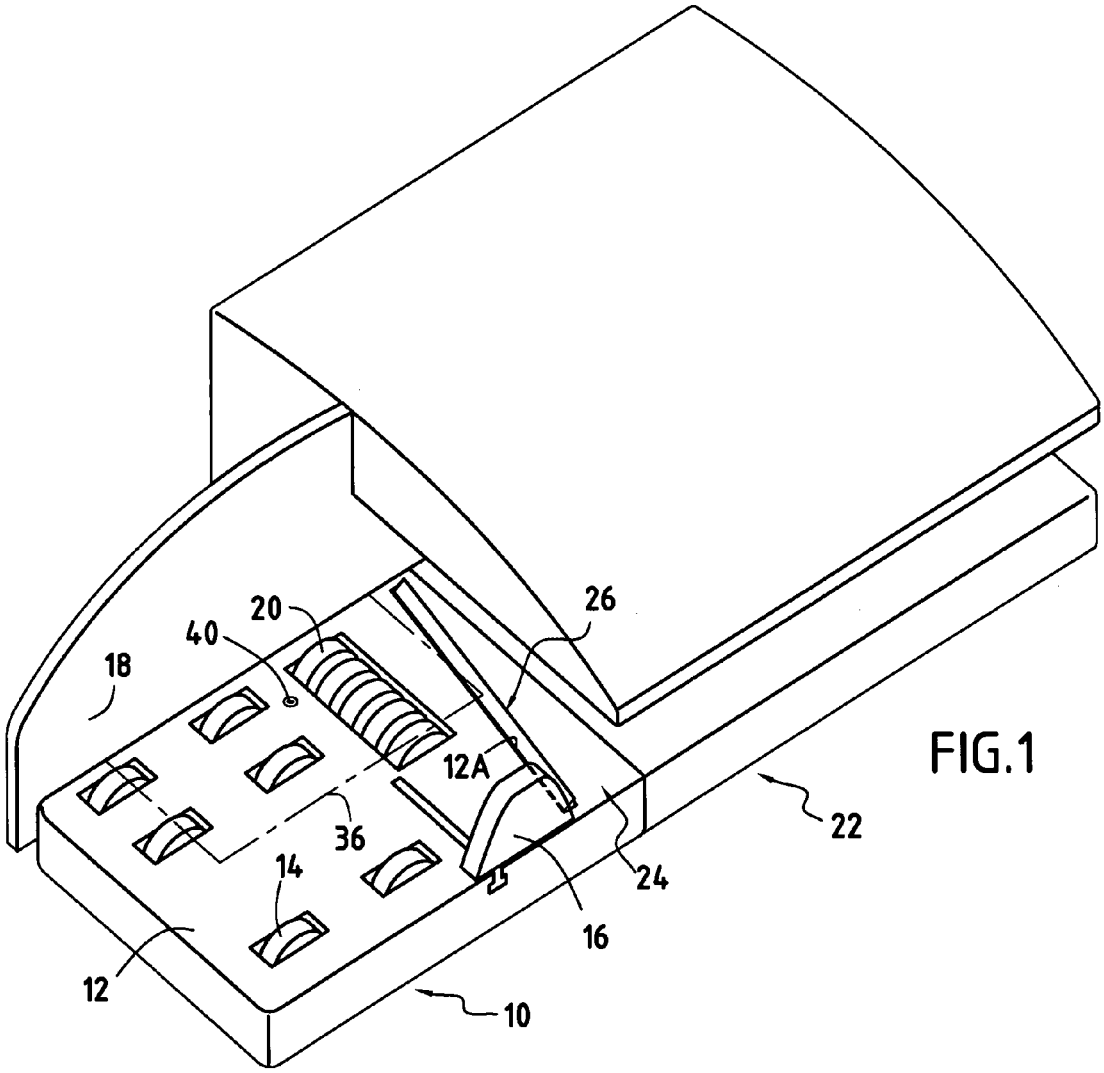
FIG. 1 is a perspective view of a mail handling machine incorporating a device for measuring the width of a mail item of the invention.
Figure 2:
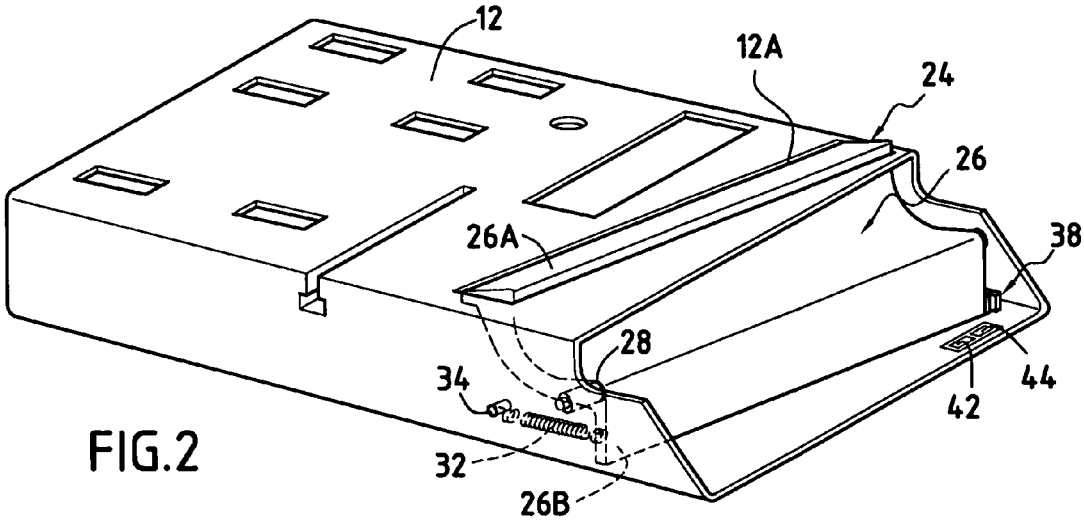
FIG. 2 is a detail view of FIG. 1.

FIGS. 1 and 2 show a mail handling machine incorporating a mechanical device of the invention for measuring the width L of a mail item. The mail handling machine conventionally comprises, from upstream to downstream (in the direction in which the mail items travel through the machine): a feed module 10 provided with a deck 12 on which the mail items to be franked are placed in a compact stack that can be uniform or non-uniform (depending on whether or not the mail items are of the same size); drive rollers 14 for moving the mail items downstream and jogger means (advantageously side jogger means 16 and/or back jogger means) for jogging the mail items against a reference wall or "envelope guide" 18; a selector module (of which only the bottom rollers 20 are shown) for extracting the mail items to be franked one by one from the bottom of the stack while also imparting a generally constant speed of movement V to them; and a franking module 22 for printing a postage imprint on the mail item selected in this way.

In accordance with the invention, the machine further comprises a mechanical device 24 for measuring the width of each mail item, which device is advantageously disposed at the outlet of the selector module, and, in a preferred embodiment, comprises a single pivotally-mounted lever 26 disposed across the path along which the mail items are conveyed, and forming an angle θ relative to the reference wall 18. The angle θ is an acute angle ($0<\theta<90°$) formed from the lever towards the wall in the opposite direction to the direction in which the mail items move, and preferably lying in the range 50° to 80° for reasons of compactness, without this range being limiting in any way.

The lever is hinged to a shaft 28 that is secured at both of its ends to the frame of the mail-handling machine, and preferably to the deck of the feed module. The lever can be generally swan-neck shaped and has a first end portion that is advantageously triangular 26A designed to pass through an opening 12A in the deck 12, and a second end portion 26B that is opposite to the first end portion about the pivot axis of the shaft 28, said second end portion being designed to receive a first end of at least one resilient element 32 whose other end is secured to a support bar 34 mounted in stationary manner in the frame and parallel to the common shaft. The resilient element, e.g. a spring, is adjusted so as not to hinder movement of the mail items 36 through the machine, and thus so as to enable the lever 26 both to retract merely under the weight of a mail item going past it and also to return to its initial position once the mail item has gone past. The state of the lever (displaced or not displaced) is determined by a device for detecting displacement of said lever, e.g. a fork contactor 38 having a moving portion secured to the lever and designed to co-operate with at least one stationary portion secured to the frame of the mail handling machine.

Figure 3:
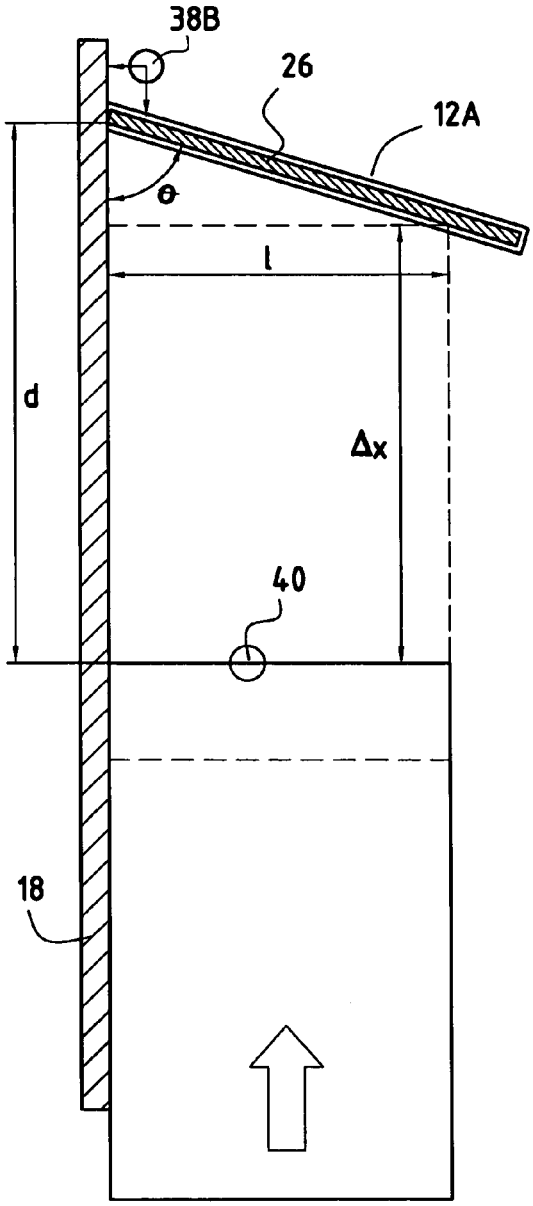
FIGS. 3 and 4 are diagrammatic plan views of the device of FIG. 1 in two different embodiments.

FIG. 3 is a diagrammatic plan view showing how the lever 26 is disposed relative to a mail item 36 in this preferred embodiment of the invention, in which embodiment the mail items are jogged against the reference wall 18.

If d is the distance set by construction between a sensor 40 for detecting the leading edge of the mail item and the lever 26 at the reference wall 18, and with the angle θ being known because it is also set by construction, it can be shown that knowledge merely of the movement of the mail item from the sensor 40 to the lever 26 suffices to determine the width L of said mail item.

If Δx is the distance projected onto the reference wall between said sensor and the point at which the lever is activated, the following equation is obtained:

$$\tan\theta = L/(d-\Delta x)$$

or indeed:

$$L = \tan\theta * (d-\Delta x)$$

Thus, for example, by placing an encoder (not shown) on the drive system for driving the mail items, and by making provision for the encoder to be triggered by activation of sensor 40 and to be stopped by activation of the contactor 38, it is easy to obtain the distance Δx from which the width L of a mail item will be deduced. It should be noted that, with this configuration, the precision of the value of the width then depends only on the step-size of the encoder.

Figure 4:
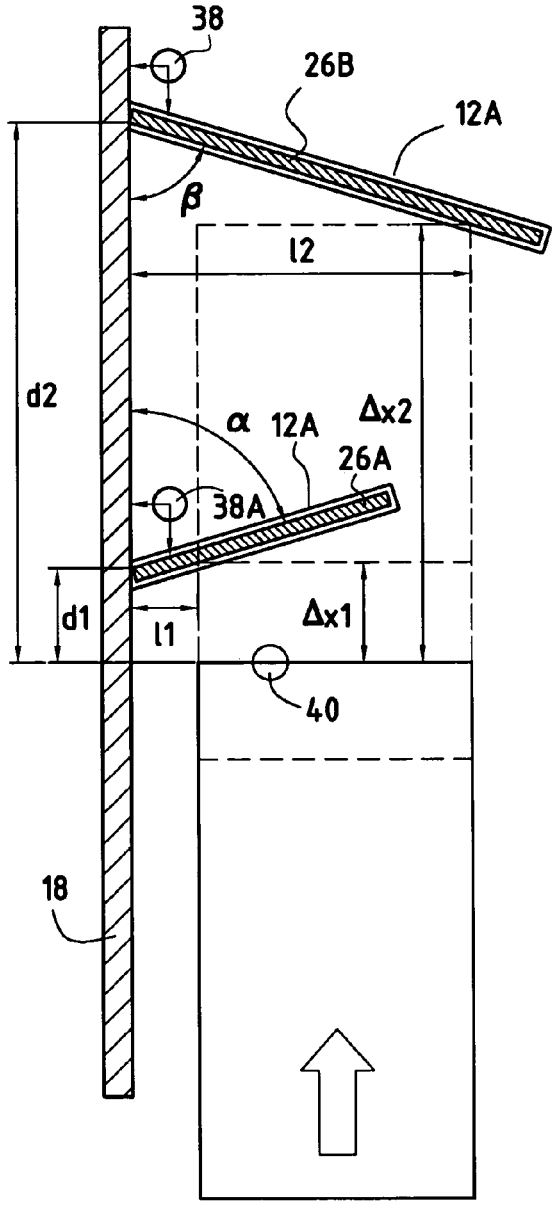

A second embodiment of the invention is shown in FIG. 4. In this other embodiment, the mail items 36 move parallel to the reference wall 19, without being jogged thereagainst, and the mechanical device 24 for measuring the width of each mail item comprises in succession (in the direction in which the mail items move): a pivotally mounted upstream lever 26A disposed across the path along which the mail items are conveyed and forming an angle α relative to the reference wall 18; and a pivotally-mounted lever 26B disposed across the path along which the mail items are conveyed and forming an angle β relative to the reference wall 18. The angle α is an acute angle ($0<\alpha<90°$) formed from the lever towards the wall in the direction in which the mail items move, and typically lies in the range 50° to 80° for reasons of compactness, without this range being limiting in any way, and the angle β is an acute angle ($0<\beta<90°$) formed from the lever towards the wall in the direction opposite from the direction in which the mail items move, and typically lies in the range 50° to 80° for reasons of compactness, without this range being limiting in any way.

As in the preceding embodiment, each of the levers is hinged to a shaft that is secured at both of its ends to the frame of the mail handling machine.

If d1 is the distance set by construction between the sensor 40 for detecting the leading edge of the mail item and the upstream lever 26A at the reference wall 18, and with the angle α being known because it is also set by construction, it is possible, as above, to use the following equation:

$$\tan\alpha = L1/(\Delta x1-d1)$$

where Δx1 is the distance projected onto the reference wall between said sensor 40 and the point of activation of the upstream lever 26A, to determine the distance L1 between the reference wall and the left edge of the mail item, i.e.:

$$L1 = \tan\alpha * (\Delta x1-d1)$$

Similarly, if d2 is the distance set by construction between the sensor 40 for detecting the leading edge of the mail item and the downstream lever 26A at the reference wall 18, and with the angle β being known because it is also set by construction, it is possible, as above, to use the following equation:

$$\tan\beta = L2/(d2-\Delta x2)$$

where Δx2 is the distance projected onto the reference wall between said sensor 40 and the point of activation of the downstream lever 26B, to determine the distance L2 between the reference wall and the right edge of the mail item, i.e.:

$$L2 = \tan\beta * (d2-\Delta x2)$$

and hence the width L of the mail item:

$$L=L2-L1=\tan\beta^*(d2-\Delta x2)-\tan\alpha^*(\Delta x1-d1)$$

Thus, by placing an encoder (not shown) on the drive system for driving the mail items, and by making provision for the encoder to be triggered by activation of the sensor 40 and for the two successive encoding readings to be triggered by activation of a first contactor (38A) and then of a second contactor (38B), the first contactor being associated with the upstream lever 26A, and the second contactor being associated with the downstream lever 26B, it is easy to obtain the distances Δx1 and Δx2 from which the width L of a mail item will be deduced. It should be noted that, with this configuration, the precision of the value of the width then also depends only on the step-size of the encoder.

Figure 5:
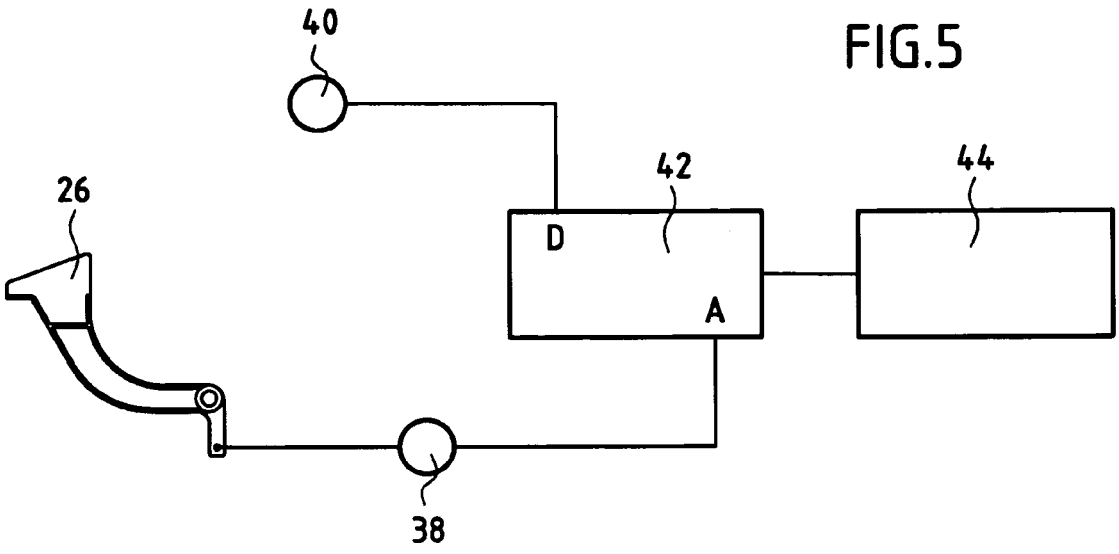
FIG. 5 is a block diagram showing the main elements of an example of a processing circuit that can be incorporated into the device of the invention.

With reference to FIG. 5, a description is given below of an example of a processing circuit that can be implemented for the first embodiment of the mechanical measurement device of the invention. The person skilled in the art can, without any difficulty, adapt the circuit to use with the second embodiment.

The processing circuit includes firstly the mail item leading edge detector device 40 disposed on the mail item conveyor path upstream from the lever 26 (relative to the direction of movement of the mail items). The term "activation" is used herein to designate the state of the detector device when a mail item passes in the vicinity thereof and, for example, for a mechanical contactor, when a mail item comes into contact with the contact end thereof.

The sensor 40 being activated causes a counter 42 to start counting pulses, and said counter is caused to stop by the contactor 38 opening as a result of the lever 26 being activated. The number of pulses counted between the counter starting counting and stopping counting gives a distance Δx of movement of the mail item on the basis of which a computation device 44, advantageously a microprocessor device, connected to the outlet of the counter makes it possible, inter alia, to compute the width L of the mail item as a function of the preceding equations.

Figure 6:
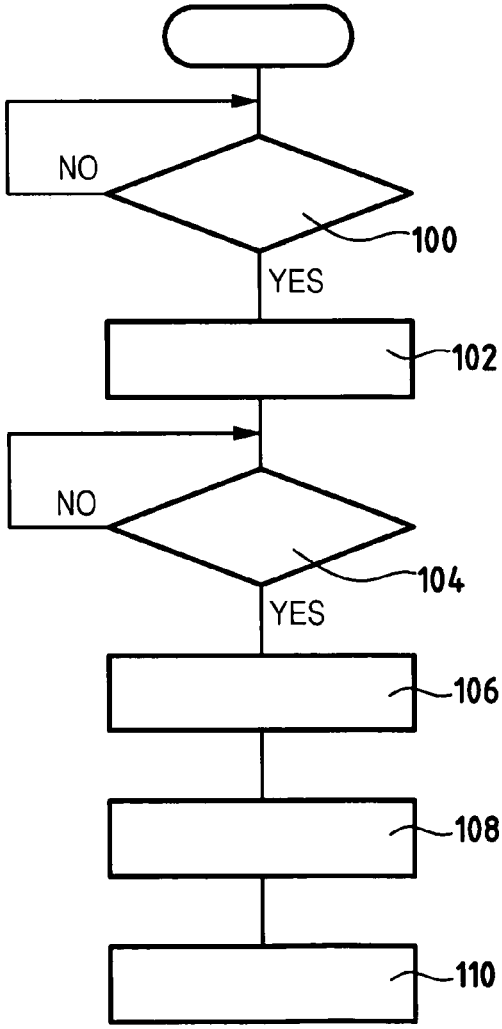
FIG. 6 is a flow chart showing an example of various steps implemented for measuring the width of a mail item on the fly in accordance with the invention.

An example of data-processing implemented in the above-mentioned circuit is explained below with reference to the flow chart in FIG. 6.

A test 100 examines whether the sensor 40 is activated. If it is not activated, the processing returns to the inlet of said test 100. If the sensor is activated, the processing goes to the step 102 for starting the counter 42. When, by means of the contactor opening 38, a test 104 detects that the lever 26 is activated, the processing goes to the step 106 for stopping the counter, and then to the step 108 for determining the value L of the mail item by means of the computation device 44. A step 110 reinitializes the process, optionally with the counter 42 being reset.

It should be noted that, in the above-mentioned examples, the values Δx, Δx1, Δx2 are obtained on the basis of an encoder that is advantageously disposed on the drive means for driving the mail items, the counter 42 counting the steps of the encoder. However, it is equally possible to obtain said values from a timer which is caused to start counting by the sensor 40 and which is caused to stop counting by the contactor 38 opening as a result of the lever 26 being activated. The number of pulses between the counter starting and the counter stopping gives a time t of movement of the mail item, which time, associated with the known speed V of movement of the mail items along the conveyor path, gives the value Δx and, as above, the width L of said mail item, the precision of the width then no longer depending on the step-size of the encoder.

What is claimed is:

1. A mechanical device for measuring the width L of a mail item on the fly in a mail handling machine in which mail items are caused to move along a mail item conveyor path, parallel to a reference wall; said mechanical device comprising a device for detecting a leading edge of a mail item, an upstream lever disposed across said mail item conveyor path and forming a determined angle relative to said reference wall, a device for detecting said upstream lever moving as said leading edge of the mail item goes past, a downstream lever disposed across said mail item conveyor path and forming a determined angle relative to said reference wall, a device for detecting said downstream lever moving as said leading edge of the mail item goes past, a device for determining a first movement distance over which said leading edge of the mail item moves between said device for detecting a leading edge of a mail item and a point of activation at which said leading edge activates said upstream lever, which point of activation is determined by said device for detecting said upstream lever moving, and for also determining a second movement distance over which said leading edge of the mail item moves between said device for detecting a leading edge of a mail item and a second point of activation at which said leading edge activates said downstream lever, which second point of activation is determined by said device for detecting said downstream lever moving, and a computation device for computing said width L of the mail item on the basis of said first and second movement distances.

2. A device according to claim 1, wherein said device for determining said movement distances over which said leading edge of the mail item moves comprises a counter which is caused to start counting by said device for detecting a leading edge of a mail item and which is caused to stop counting by said detection device(s) for detecting said lever(s) moving.

3. A device according to claim 1, wherein each lever is hinged to a shaft secured at both of its ends to a frame of the mail handling machine.

4. A device according to claim 3, wherein each hinged lever is advantageously swan-necked in general shape, with an advantageously triangular first end portion designed to pass through an opening in a deck of the mail handling machine, and a second end portion that is opposite to the first end portion about the pivot axis of said common shaft, and that is designed to receive a first end of at least one resilient element whose other end is secured to a support bar mounted transversely in the frame.

5. A device according to claim 4, wherein said second end portion further has a moving first element designed to cooperate with a stationary second element secured to the frame of the mail-handling machine so as to form said device for detecting the lever moving.

6. A method of measuring the width L of a mail item on the fly in a mail handling machine in which mail items are caused to travel along a mail item conveyor path, parallel to a reference wall; said method comprising the steps:

detecting a leading edge of a mail item at a device for detecting a leading edge of a mail item;

detecting the presence of said leading edge of a mail item at an upstream lever disposed across said mail item conveyor path and forming a determined angle relative to said reference wall, detecting the presence of said leading edge of the mail item at a downstream lever disposed across said mail item conveyor path and forming a determined angle relative to said reference wall;

determining a movement distance between said device for detecting a leading edge of a mail item and a point of activation at which said leading edge activates said upstream lever, which point of activation is delivered by a device for detecting said upstream lever moving as said leading edge of the mail item goes past determining a movement distance between said device for detecting a leading edge of a mail item and a second point of activation at which said leading edge activates said downstream lever, which second point of activation is delivered by a device for detecting said downstream lever moving as said leading edge of the mail item goes past; and computing the width L of the mail item on the basis of said first and second movement distances.

7. A mail handling machine including a mechanical device according to claim 1 for measuring the width L of a mail item on the fly.

8. A device according to claim 1, wherein said computation device computes said width based on a combination of said first and second distances.

9. A device according to claim 8, wherein said computation device combines said distances taking into account angles formed between each of said upstream and downstream levers and said conveyor path.

10. A method according to claim 6, wherein said computing step computes said width based on a combination of said first and second distances.

11. A method according to claim 10, wherein said computing step combines said distances taking into account angles formed between each of said upstream and downstream levers and said conveyor path.

* * * * *